United States Patent [19]

Auding et al.

[11] Patent Number: 4,889,974

[45] Date of Patent: Dec. 26, 1989

[54] THIN-FILM HEATING ELEMENT

[75] Inventors: Hans Auding; Günter Frank; Heiner Köstlin; Bruno Vitt, all of Aachen, Fed. Rep. of Germany

[73] Assignee: U.S. Philips Corporation, New York, N.Y.

[21] Appl. No.: 158,522

[22] Filed: Feb. 22, 1988

[30] Foreign Application Priority Data

Feb. 21, 1987 [DE] Fed. Rep. of Germany ..... 3705639

[51] Int. Cl.[4] ..... H05B 3/16

[52] U.S. Cl. ..... 219/543; 338/308

[58] Field of Search ..... 219/543, 544; 338/308, 338/309; 106/1.05, 1.12, 287.23

[56] References Cited

U.S. PATENT DOCUMENTS 3,551,195 12/1970 Wada et al. ..... 338/308 X 4,340,508 7/1982 Wahler et al. ..... 338/308

*Primary Examiner*—Clifford C. Shaw

*Assistant Examiner*—M. M. Lateef

*Attorney, Agent, or Firm*—Norman N. Spain

[57] ABSTRACT

A thin-film heating element is formed of a temperature-stable, electrically insulating substrate having a thin, electrically conductive metal oxide film which is doped with foreign atoms which compensate each other in pairs and which each consist of at least one acceptor-forming element and one donor-forming element the metal oxide film being provided with connecting electrodes; the metal oxide film being doped with maximally 10% of each of the foreign atoms compensating each other in pairs, the quantity of the atoms differing maximally 10%.

10 Claims, 1 Drawing Sheet

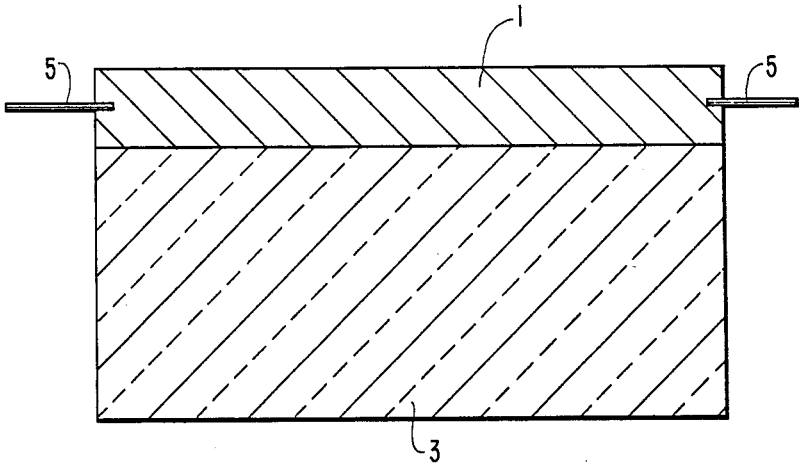
1
5
5
3

THIN-FILM HEATING ELEMENT

BACKGROUND OF THE INVENTION

The invention relates to a thin-film heating element comprising a temperature-stable, electrically insulating substrate having a thin electrically conductive metal oxide film which is doped with pairs of compensating foreign atoms and each of which pairs consist of at least one acceptor-forming element and one donor-forming element, the metal oxide film being provided with connecting electrodes.

An acceptor is a local impurity in a semiconductor, which either accepts an electron or supplies a mobile hole. The corresponding electronic energy level is situated in the forbidden band, the exact location together with the capture cross-section of the electrons determining the operation of the acceptor. When acceptors are used as dopants, the host lattice atom is replaced by an atom having one valence electron less than the host lattice atom. A donor is an impurity in a semiconductor, which can give up one of its electrons. The corresponding electronic energy level is situated in the forbidden band, the operation of the donor being determined by the exact location and the capture cross-section of the electrons and mobile holes. When donors are used as dopants, a host lattice atom is replaced by an atom having one valence electron more than the host lattice atom.

It is known from, for example, U.S. Pat. No. 3,108,019 that electrically conductive, thin metal oxide films on a temperature-stable, electrically insulating substrate are used as resistance elements in heating devices such as, for example, heated windows (for example car windows), warming trays or similar devices, these thin layers being used as heating elements in a temperature range up to 500° C. For this purpose, glass substrates or ceramic substrates are coated in a pyrolytic deposition process from solutions containing, for example, the chlorides, bromides, iodides, sulphates, nitrates, oxalates or acitates of tin, indium, cadmium, tin and antimony, tin and indium or tin and cadmium with or without a dopant such as tin, iron, copper or chromium. The films formed by pyrolytic deposition then consist of the corresponding metal oxide(s).

In certain applications, thin-film heating elements which can attain surface temperatures exceeding 500° C. are preferably used.

For the sake of completeness, it is pointed out that thin electrically conductive indium oxide films are known from U.S. Pat. No. 2,564,709, which are doped with foreign atoms in a quantity up to 10 at %, which atoms compensate each other in pairs and which each consist of at least one acceptor-forming element and one donor-forming element, the quantities of the acceptor-forming elements and the donor-forming elements, however, differing more than 10%. This known coating material has proved to be insufficiently stable at higher surface temperatures.

SUMMARY OF THE INVENTION

It is an object of the invention to provide a thin-film heating element having a stability and a resistance at temperatures exceeding 600° C., such that it can be operated from mains.

This object is achieved according to the invention in that the metal oxide film is doped with maximally 10 at.% of each of the foreign atoms which compensate each other in pairs, the concentration of the which donor-forming element and the acceptor-forming elements differing from each other at most by 10%.

The invention is based on the recognition that by using thin, electrically conductive metal oxide films on correspondingly temperature-stable substrates, surface temperatures of 1000° C. can be obtained at power densities exceeding 10 W/cm$^2$, which corresponds to current densities exceeding 1000 A/cm$^2$, and a low positive temperature coefficient of electrical resistance $\alpha = 3.10^{-4}$ K.$^{-1}$, when the metal oxide films are doped with relatively high and approximately equal quantities of foreign atoms which compensate each other in pairs and each pair of which consists of at least one acceptor-forming element and one donor-forming element. The relatively high doping level leads to a reduced electron mobility and, hence, to relatively high resistance values. The low positive temperature coefficient of electric resistance and the temperature stability of the inventive layers is attributed to the pair-wise compensation of the elements forming the acceptors and donors.

BRIEF DESCRIPTION OF THE DRAWING

In the drawing the sole FIGURE is a cross-sectional view of a heating element of the invention.

DETAILED DESCRIPTION OF THE INVENTION

The invention will now be described in greater detail.

According to advantageous further embodiments of the invention, $SnO_2$-films are used as metal oxide films and are provided on hard glass substrates, quartz glass substrates or ceramic substrates to form the heating element. The metal oxide films cannot be considered separately from the substrate, in particular in regard to the thermal stability, the thermal coefficient of expansion of the substrate material and also a possible diffusion of foreign matter from the substrate into the metal oxide layer playing a part.

The outcome of the experiments on which the manufacture of the present heating elements is based is a surprise in that quartz glasses and glass ceramics having an extremely low coefficient of expansion ($\alpha 0/1000 \approx 0.5$ or $0.1.10^{-6}$ K.$^{-1}$) have proved to be just as suitable substrates for a coating with doped $SnO_2$-films or $In_2O_3$-films ($\alpha \approx 4.10^{-6}$ K.$^{-1}$) than, for example, hard glasses having a coefficient of expansion $\alpha \approx 3$ to $4.10^{-6}$ K.$^{-1}$.

According to advantageous further embodiments of the invention, a $SnO_2$-film is doped with indium, boron and/or aluminum as acceptor-forming element(s) and with antimony and/or fluorine as donor-forming element(s).

According to a still further advantageous embodiment of the invention, the metal oxide film is doped with at least one acceptor-forming element and one donor-forming element in a quantity from 3 to 5 at.%.

The advantages obtained by means of the invention are, in particular, that heating elements are obtained which can abruptly be switched on and off and which reach the final temperature after a relatively short time ($\approx$4 to 5 min) due to their relatively low heat capacity, and which cool just as rapidly after they have been deenergized. A further advantage is that the metal oxide films according to the invention are optically clear, free from scattering, free from reams and cracks and that they exhibit a high degree of transparency. These properties of the inventive metal oxide films are particularly advantageous when transparent substrates are used; for example, a toaster can be provided with transparent heating plates, in which the degree of browning of the food can readily be checked visually.

Life tests have shown that the properties of the inventive heating elements remain unchanged over several thousands of operating hours and switching cycles in air. This is also true for heating elements having large surfaces exceeding 1 $dm^2$. A further advantage is that the surface resistance of the inventive films can be selected such that, after the electrodes have been provided for example metal film electrodes, they can immediately be operated from mains.

Consequently, to obtain an adapted electric resistance it is not necessary to provide the layer with a intrically-shaped pattern, which would require a high technological expenditure and besides holds the risk of flashover during applications at an operational voltage of 220 V.

The invention will now be explained in more detail by means of exemplary embodiments.

Films according to the invention were manufactured from a solution by means of a spray pyrolysis process. For this purpose, 9.6 g of $SbCl_3$ and 9.3 g $InCl_3$ are dissolved as dopants in a solution of 100 ml of $SnCl_4$ in 500 ml of butyl acetate. This quantity of dopant corresponds to a doping of 4.5 at. % of Sb and 4.5 at. % of In.

A doping having zinc as the acceptor-forming element is also possible.

$SnO_2$-films having a free charge carrier density of $N \approx 6.10^{20}/cm^3$ were applied by spraying the above-mentioned solution as a fine aerosol onto 500° C. hot substrates having a dimension of $15 \times 15$ $cm^2$, and which are made of hard glass which is commercially available under the trade names Pyrex or tempax. The layers had a thickness of 0.1 μm and after a tempering process (forming process) in air at a temperature of 600° C. for 1 hour they had a surface resistance of 160 Ω. The actual terminal resistance of the inventive layers, expressed as surface resistance $R = \delta/d$ ($\delta$ = specific resistance of the metal oxide film, d = layer thickness) is determined by a suitable choice of the dopants and the layer thickness. The metal oxide films produced within the framework of the invention exhibit surface resistances of between approximately 20 and 500 Ω at layer thicknesses in the range from 0.05 to 0.5 μm.

The coated substrate which was manufactured as described above was used to construct a transparent toaster after the metal film electrodes, for example of silver, had been provided. At a surface temperature of 520° C., browning of the slices of bread could be observed after approximately 3 minutes.

Using the above-described solution for the manufacture of doped $SnO_2$-layers, glass ceramic substrates having a dimension of $15 \times 15$ $cm^2$ were coated with $SnO_2$-films having a thickness of 0.3 μm. Also after a forming process at a temperature of ≈600° C. for ≈1 hour, these layers had a stable surface resistance of ≈60 Ω. The substrates thus coated were also provided with metal film electrodes, and these heating elements were used to construct electrically heated hot plates which were operated at a voltage of 220 V, a power of 800 W and a surface temperature of 600° C. After switching it on and off 200 times the electric resistance of the layers was unchanged. This heating element was still in good working condition at a power of 1.1 kW.

Within the scope of the present invention, it is also possible to provide, for example, quartz glass tubes, quartz glass rods or quartz glass plates with the inventive metal oxide films. Quartz glass tubes can, for example, be used as heat exchangers in flow heaters, in coffee-makers or in general as heat exchangers in professional applications.

Whereas on glass ceramic substrates continuous operation of the heating elements up to the recrystallization temperature of approximately 700° C. is possible, quartz glass tubes, quartz glass rods or quartz glass plates can be used at operating temperatures of 1000° C. By way of example a quartz glass plate of 1 $dm^2$ and having a surface resistance of R = 37 Ω was operates at this temperature for 1000 h.

Heating elements having plate-shaped substrates can also be used as heating members for toasters, heater or cook-top elements, hot-plates, table-top broilers, irons, or as bottom heating in heatable vacuum flasks or similar devices.

Heating elements having tubular substrates can be used as heat exchangers for flow-heaters, coffee-makers, dish-washers, washing-machines, tumble-dryers, hot air heaters, hair-dryers or similar devices.

Heating elements having rod-like or tubular substrates can, for example, be used as infrared radiators or radiation furnaces.

We claim:

1. A thin-film heating element comprising a temperature-stable, electrically insulating substrate having a thin, electrically conductive metal oxide film which is doped with foreign atoms which compensate each other in pairs and each of which pairs consist of at least one acceptor-forming element and one donor-forming element, the metal oxide film being provided with connecting electrodes, characterized in that the metal oxide film is doped with maximally 10 at % of each of the foreign atoms compensating each other in pairs, the quantity of said acceptor-forming elements and said donor-forming elements differs maximally by 10%.

2. A heating element as claimed in claim 1, characterized in that the metal oxide film is a $SnO_2$-film.

3. A heating element as claimed in claim 2, characterized in that the metal oxide film is doped with indium, boron and/or aluminum as acceptor-forming element(s).

4. A heating element as claimed in claim 2, characterized in that the metal oxide film is doped with antimony and/or fluorine as donor-forming element(s).

5. A heating element as claimed in claim 2, characterized in that the metal oxide film is doped with zinc as an acceptor-forming element.

6. A heating element as claimed in claim 1, characterized in that the metal oxide film is doped with at least one acceptor-forming element and at least one donor-forming element, in a quantity from 3 to 5 at. %.

7. A heating element as claimed in claim 1, characterized in that the metal oxide film is produced by pyrolysis of a solution containing the elements used to produce the layer.

8. A heating element as claimed in claim 1, characterized in that the substrate consists of hard glass.

9. A heating element as claimed in claim 1, characterized in that the substrate consists of quartz glass.

10. A heating element as claimed in claim 1, characterized in that the substrate consists of a ceramic.

* * * * *